US005974669A

United States Patent [19]

Bertino

[11] Patent Number: 5,974,669

[45] Date of Patent: Nov. 2, 1999

[54] CIGAR CUTTER MONEY CLIP

[76] Inventor: Michael Bertino, 912 Plainfield Rd., Joliet, Ill. 60435

[21] Appl. No.: 09/105,862

[22] Filed: Jun. 26, 1998

[51] Int. Cl.[6] ..... A24F 13/24

[52] U.S. Cl. ..... 30/113; 30/151; 30/298.4

[58] Field of Search ..... 30/113, 151, 298.4

[56] References Cited

U.S. PATENT DOCUMENTS

| | | | |
|---|---|---|---|
| 4,481,712 | 11/1984 | Phelps | 30/151 |
| 4,675,953 | 6/1987 | Higgs | 24/499 |
| 5,217,150 | 6/1993 | Chen | 224/163 |
| 5,643,114 | 7/1997 | Marcus | 473/408 |
| 5,697,131 | 12/1997 | Hunt et al. | 24/563 |
| 5,722,430 | 3/1998 | Bentley et al. | 131/243 |
| 5,759,120 | 6/1998 | Mathis et al. | 473/408 |
| 5,791,051 | 8/1998 | Schmidt | 30/113 |
| 5,819,750 | 10/1998 | Moyer | 131/175 |

*Primary Examiner*—M. Rachuba
*Assistant Examiner*—Stephen Choi

[57] ABSTRACT

A first cigar cutter money clip (110) having a cigar cutter (12) which has a hollow cigar cutter housing (12A) having at least one cigar cutter housing opening (12AA) positioned through a side thereof. The cigar cutter (12) further has a cigar cutter gilliotine (12B) slidably disposed in the cigar cutter housing (12A). The cigar cutter gilliotine (12B)has a cigar cutter gilliotine blade (12BA) having a sharp cigar cutter gilliotine blade edge (12BAA). The first cigar cutter money clip (110) further having a money clip (14) movably connected along a bottom edge of the cigar cutter housing (12A) by a hinge (16). The money clip (14) functions to hold at least one bill (18) against the side of the cigar cutter housing (12A).

1 Claim, 8 Drawing Sheets

CIGAR CUTTER MONEY CLIP

BACKGROUND OF THE INVENTION

1. Field of the Invention

The present invention relates to smoking accessories. More particularly, the present invention relates to a cigar cutter in combination with a money clip.

2. Description of the Prior Art

Money clips are used to secure bills when they are removed from a user's pocket. A cigar clip is used to clip the ends of a cigar before smoking. When both are, contain in a pocket the combination creates a unwanted and unsightly bulge. What is needed is a combination money clip and cigar clip.

Numerous innovations for a cigar cutter and money clip have been provided in the prior art that are described as follows. Even though these innovations may be suitable for the specific individual purposes to which they address, they differ from the present invention as hereinafter contrasted.

In U.S. Pat. No. 1,094,338, titled Cigar Cutter, invented by Conrad H. Leisegang, a cigar cutter is described having a means for slitting the wrapper of a cigar at the proper end without severing the remainder of the wrapper. A cutting blade is arranged to retract into a protective housing. The housing has an engagement means which latches the blade to prevent inadvertent opening.

In U.S. Pat. No. 2,759,260, titled Cigar Clipper, invented by Leo J. Wisniewsk, a device is described which produces a V-shaped groove in the end of a cigar. A spring bias returns the cutter blade to an initial position.

In U.S. Pat. No. 1,776,283, titled Combination Key Pencil Sharpener and Cigar Clipper, invented by Waclaw Harasimiak, is a combination pencil sharpener and cigar clipper which attached to a lock key. The patented invention functions with a single blade used for both cutting and clipping.

In U.S. Pat. No. 1,757,607, titled Cigar Cutter, invented by Samuel Zuilo, a cigar lighter and cutter are combined into a device having a cutter on one end and a lighter on the opposite end.

The above patented inventions differ from the present invention because they fail to describe or claim at least one combination of the following features depicted in the present invention a combined money clip device and a cigar cutter.

Numerous innovations for a cigar cutter and money clip have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a combination cigar clip and money clip. The cigar clip is operational without removal of money from the money clip portion. The cigar clip is of a guillotine type in which the end of the cigar is inserted into an aperture in the device and a sliding blade severs the cigar end.

The types of problems encountered in the prior art are money is desired to be securely help when removing it from a pocket and cigars need to have a portion of an end removed to permit proper smoking.

In the prior art, unsuccessful attempts to solve this problem were attempted namely: separate a money clip and cigar clip. However, the problem was solved by the present invention because both functions are combined.

Innovations within the prior art are rapidly being exploited. Cigar consumption increased 34% during 1996.

The present invention solved a long felt need for a money clip combined with a cigar clip.

Accordingly, it is an object of the present invention to a smaller sized device to hold money and function to trim the ends of cigars.

More particularly, it is an object of the present invention to provide a cigar clip which is useable without removing the money from the money clip.

In keeping with these objects, and with others which will become apparent hereinafter, one feature of the present invention resides, briefly stated, in a cigar cutter which has a cigar cutter housing containing a cigar cutter guillotine which functions to cut the ends of a cigar.

In accordance with another feature of the present invention, a hinge functions to position the cigar clip in an operable position.

Another feature of the present invention is that a cigar cutter guillotine blade slides within a cigar cutter guillotine blade slot.

Yet another feature of the present invention is that a cigar is positioned within a cigar cutter guillotine blade opening. The end of the cigar is severed when the cigar cutter guillotine handle is pushed by a user toward the cigar cutter guillotine blade opening.

Still another feature of the present invention is that a money clip is hingably attached to a cigar cutter.

Yet still another feature of the present invention is that the money clip has a money clip convex portion functioning to receive the fold of a plurality of bills.

Still yet another feature of the present invention is that a money clip concave securely and removably attaches the bills to the money clip.

Another feature of the present invention is that a money clip front end (14C) functions to permit bills to be easily slid between the money clip concave and the cigar cutter.

The novel features which are considered characteristic for the invention are set forth in the appended claims. The invention itself however, both as to its construction and its method of operation, together with additional objects and advantages thereof will be best understood from the following description of the specific embodiments when read and understood in connection with the accompanying drawings.

LIST OF REFERENCE NUMERALS UTILIZED IN THE DRAWINGS

110—first cigar cutter money clip (110)
210—second cigar cutter money clip (210)
12—cigar cutter (12)
12A—cigar cutter housing (12A)
12AA—cigar cutter housing opening (12AA)
12AB—cigar cutter housing stopper (12AB)
12AC—cigar cutter housing port (12AC)
12B—cigar cutter guillotine (12B)
12BA—cigar cutter guillotine blade (12BA)
12BAA—cigar cutter guillotine blade edge (12BAA)
12BAB—cigar cutter guillotine blade slot (12BAB)
12BAC—cigar cutter gelatin blade opening (12BAC)
12BB—cigar cutter guillotine handle (12BB)
12BBA—cigar cutter guillotine handle opening (12BBA)
14—money clip (14)

14A—money clip convex (14A)
14B—money clip concave (14B)
14C—money clip front end (14C)
16—hinge (16)
18—bills (18)
120—lock plate (20)
20A—lock plate post (20A)
22—open/closing motion (22)

DESCRIPTION OF THE PREFERRED EMBODIMENT

Figure 1:
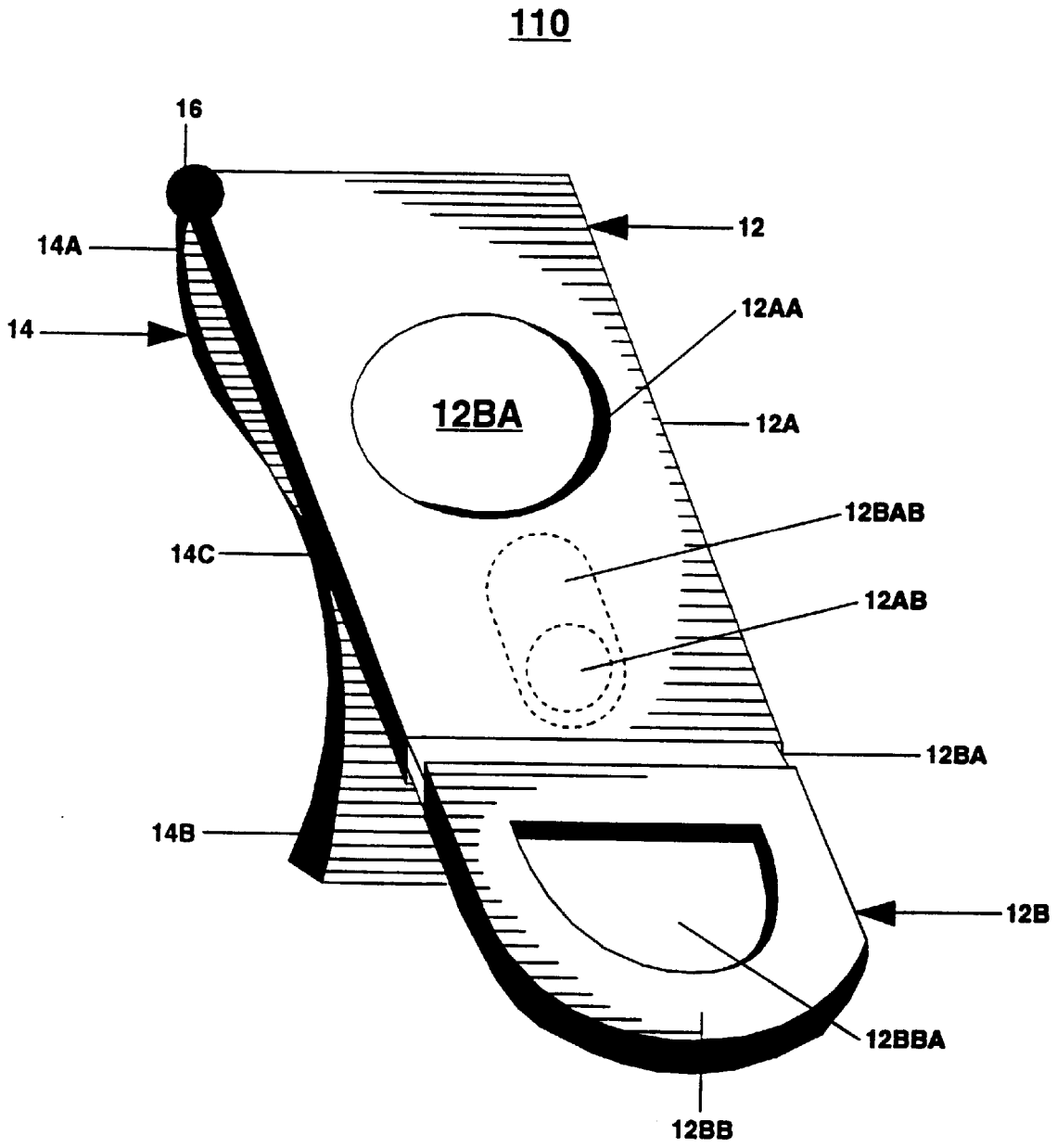
FIG. 1 is a top-left perspective view of a first cigar cutter money clip with a cigar cutter guillotine and a money clip in an open position.

Firstly, referring to FIG. 1 which is a top-left perspective view of a first cigar cutter money clip (110) with a cigar cutter guillotine (12B) and a money clip (14) in an open position. The first cigar cutter money clip (110) comprises a cigar cutter (12) which comprises a hollow cigar cutter housing (12A) having at least one cigar cutter housing opening (12AA) positioned through a side thereof The cigar cutter (12) further comprises a cigar cutter guillotine (12B) slidably disposed in the cigar cutter housing (12A). The cigar cutter guillotine (12B) comprises a cigar cutter guillotine blade (12BA). The cigar cutter guillotine (12B) further comprises a cigar cutter guillotine handle (12BB) securely attached along a top distal edge of the cigar cutter guillotine blade (12BA). The cigar cutter guillotine handle (12BB) further comprises a cigar cutter guillotine handle opening (12BBA) therein functioning as a gripping means.

The cigar cutter (12) still further comprises a cigar cutter housing stopper (12AB) positioned through the side. The cigar cutter guillotine blade (12BA) further comprises a cigar cutter guillotine blade slot (12BAB) longitudinally disposed therein. The cigar cutter housing stopper (12AB) is positioned within the cigar cutter guillotine blade slot (12BAB) functioning to prevent complete removal of the cigar cutter guillotine (12B) from the cigar cutter housing (12A).

The first cigar cutter money clip (110) further comprises a money clip (14) movably connected along a bottom edge of the cigar cutter housing (12A) by a hinge (16). The money clip (14) comprises a money clip convex (14A) attached to a money clip front end (14C) by a money clip concave (14B).

Figure 2:
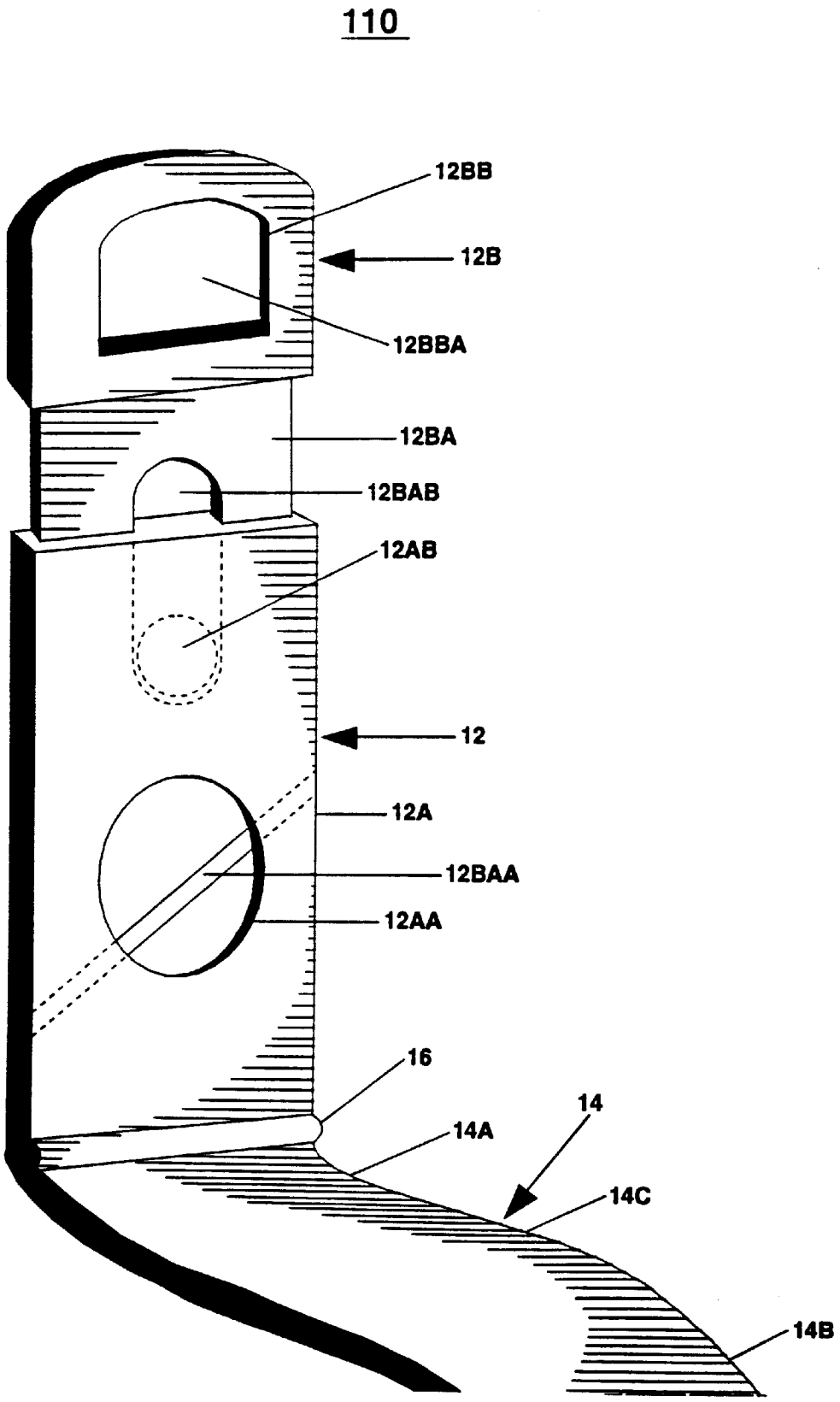
FIG. 2 is a top-left perspective view of a first cigar cutter money clip with a cigar cutter guillotine and a money clip in a closed position.

Secondly, referring to FIG. 2 which is a top-eft perspective view of a first cigar cutter money clip (110) with a cigar cutter guillotine (12B) and a money clip (14) in a closed position. The first cigar cutter money clip (110) comprises the cigar cutter (12) which comprises the hollow cigar cutter housing (12A) having at least one cigar cutter housing opening (12AA) positioned through the side thereof The cigar cutter (12) further comprises the cigar cutter guillotine (12B) slidably disposed in the cigar cutter housing (12A). The cigar cutter guillotine (12B) comprises the cigar cutter guillotine blade (12BA) having the sharp cigar cutter guillotine blade edge (12BAA). The cigar cutter guillotine blade edge (12BAA) is angled. The cigar cutter guillotine (12B) further comprises the cigar cutter guillotine handle (12BB) securely attached along the top distal edge of the cigar cutter guillotine blade (12BA). The cigar cutter guillotine handle (12BB) further comprises the cigar cutter guillotine handle opening (12BBA) therein functioning as the gripping means.

The cigar cutter (12) still further comprises the cigar cutter housing stopper (12AB) positioned through the side. The cigar cutter guillotine blade (12BA) further comprises the cigar cutter guillotine blade slot (12BAB) longitudinally disposed therein. The cigar cutter housing stopper (12AB) is positioned within the cigar cutter guillotine blade slot (12BAB) functioning to prevent complete removal of the cigar cutter guillotine (12B) from the cigar cutter housing (12A).

The first cigar cutter money clip (110) further comprises the money clip (14) movably connected along the bottom edge of the cigar cutter housing (12A) by the hinge (16). The money clip (14) functions to hold at least one bill (18) against the side of the cigar cutter housing (12A). The money clip (14) comprises the money clip convex (14A) attached to the money clip front end (14C) by the money clip concave (14B) which functions to increase holding power on the at least one bill (18).

Figure 3:
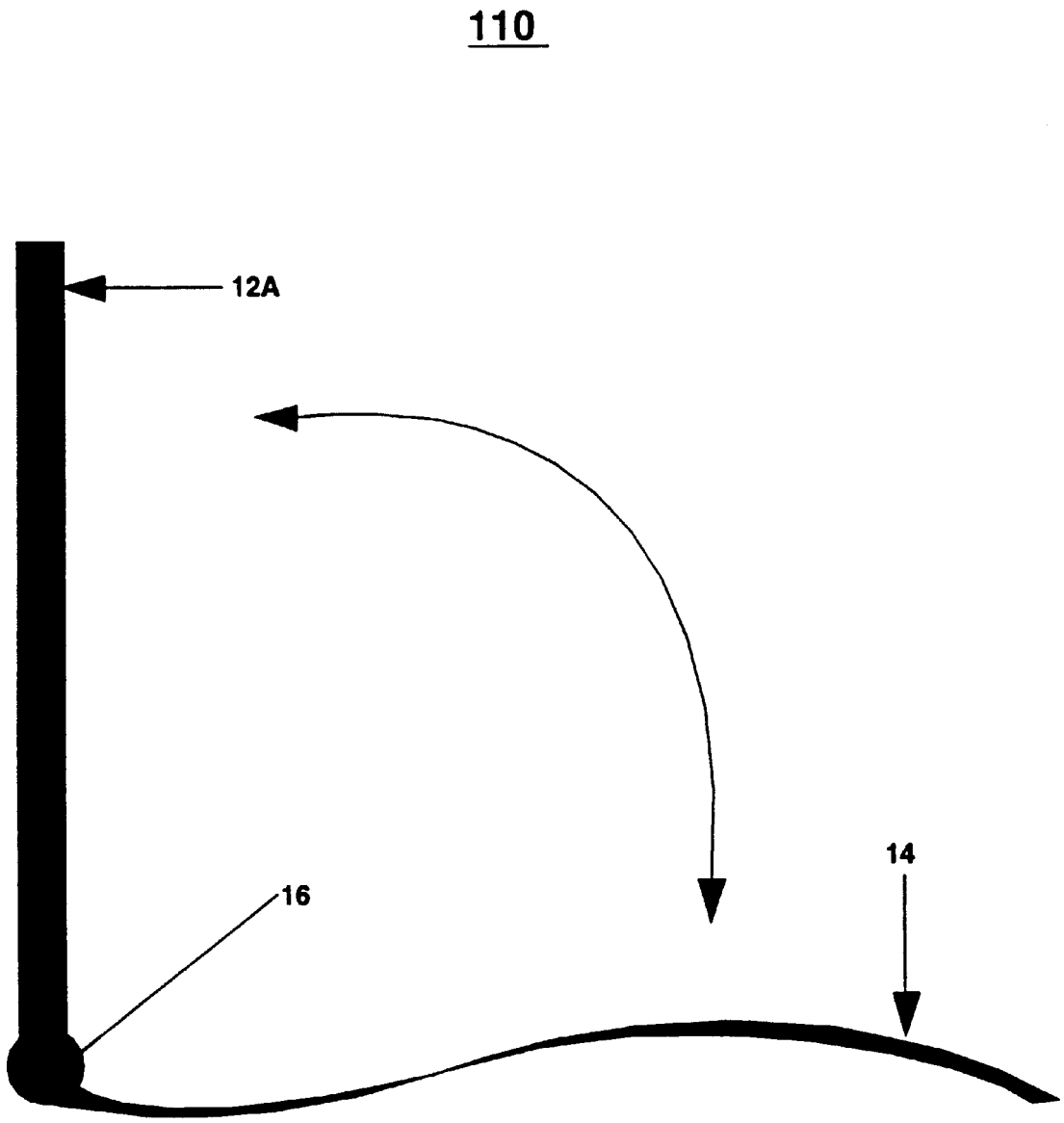
FIG. 3 is a side view of a first cigar cutter money clip with a money clip in an open position.

Thirdly, referring to FIG. 3 which is a side view of a first cigar cutter money clip (110) with a money clip (14) in an open position. The first cigar cutter money clip (110) comprises the money clip (14) which is movably connected along the bottom edge of the cigar cutter housing (12A) by the hinge (16). The first cigar cutter money clip (110) opens and closes along an open/closing motion (22)

Figure 4:
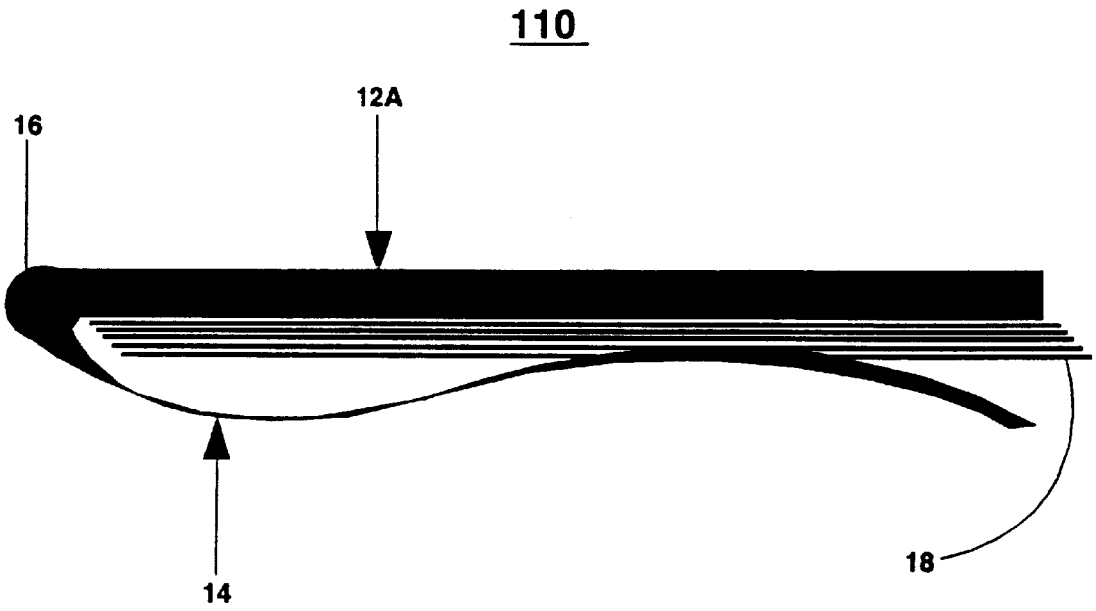
FIG. 4 is a side view of a first cigar cutter money clip with a cigar cutter guillotine and a money clip in a position holding a plurality of bills.

Fourthly, referring to FIG. 4 which is a side view of a first cigar cutter money clip (110) with a cigar cutter guillotine (12B) and a money clip (14) in a closed position. The first cigar cutter money clip (110) comprises the hollow cigar cutter housing (12A). The first cigar cutter money clip (110) further comprises the money clip (14) movably connected along the bottom edge of the cigar cutter housing (12A) by the hinge (16). The money clip (14) functions to hold at least one bill (18) against the side of the cigar cutter housing (12A).

Figure 5:
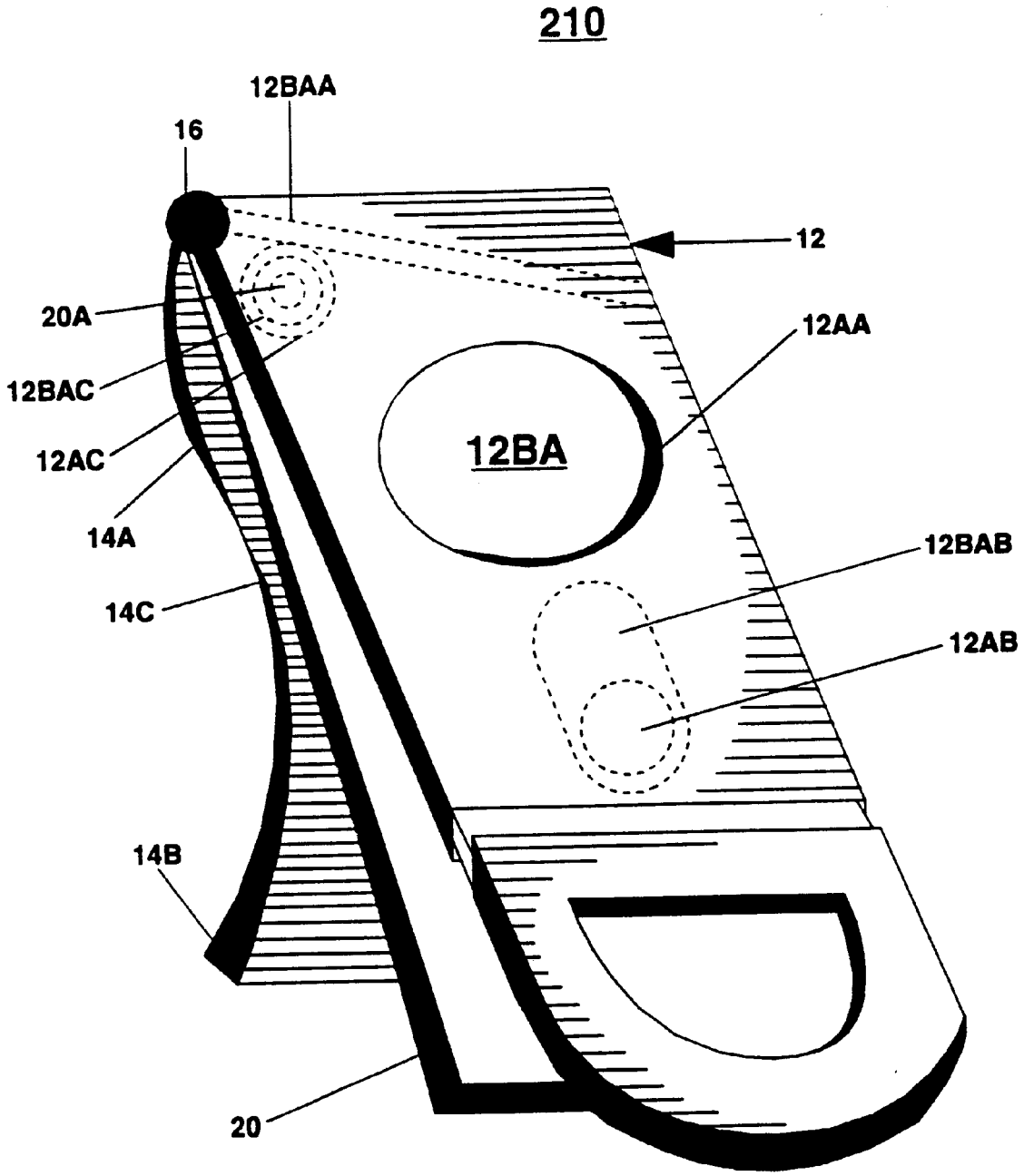
FIG. 5 is a top-left perspective view of a second cigar cutter money clip with a cigar cutter guillotine and a lock plate in an open position.

Next referring to FIG. 5 which is a top-left perspective view of a second cigar cutter money clip (210) with a lock plate (20) in a closed position. The second cigar cutter money clip (210) comprises a cigar cutter (12) which comprises at least one cigar cutter housing opening (12AA) positioned through a side thereof. The cigar cutter housing (12A) further comprises a cigar cutter housing port (12AC) therein. The cigar cutter guillotine blade (12BA) further comprises a cigar cutter guillotine blade opening (12BAC) therethrough. The cigar cutter housing (12A) further comprises a lock plate post (20A) extending upwardly therefrom. When a user positions the lock plate post (20A) against the cigar cutter housing (12A) side, the lock plate post (20A) is positioned through the cigar cutter housing port (12AC) and the cigar cutter guillotine blade opening (12BAC) preventing removal of cigar cutter guillotine blade (12BA) from the cigar cutter housing (12A).

The cigar cutter guillotine (12B) comprises a cigar cutter guillotine blade (12BA) having a sharp cigar cutter guillotine blade edge (12BAA). The cigar cutter guillotine blade edge (12BAA) is angled. The cigar cutter guillotine (12B) still further comprises a cigar cutter guillotine handle (12BB) which is securely attached along a top distal edge of the cigar cutter guillotine blade (12BA). The cigar cutter guillotine handle (12BB) further comprises a cigar cutter guillotine handle opening (12BBA) therein functioning as a gripping means.

The cigar cutter (12) further comprises a cigar cutter housing stopper (12AB) positioned through the side, the cigar cutter guillotine blade (12BA) further comprises a cigar cutter guillotine blade slot (12BAB) longitudinally disposed therein The cigar cutter housing stopper (12AB) is positioned within the cigar cutter guillotine blade slot (12BAB) functioning to prevent complete removal of the cigar cutter guillotine (12B) from the cigar cutter housing (12A).

The second cigar cutter money clip (210) still further comprises a money clip (14) securely attached along a bottom edge to a bottom of the cigar cutter housing (12A). The money clip (14) functions press against the side of the lock plate (20). The money clip (14) comprises a money clip convex (14A) attached to a money clip front end (14C) by a money clip concave (14B) which functions to increase holding power.

Figure 6:
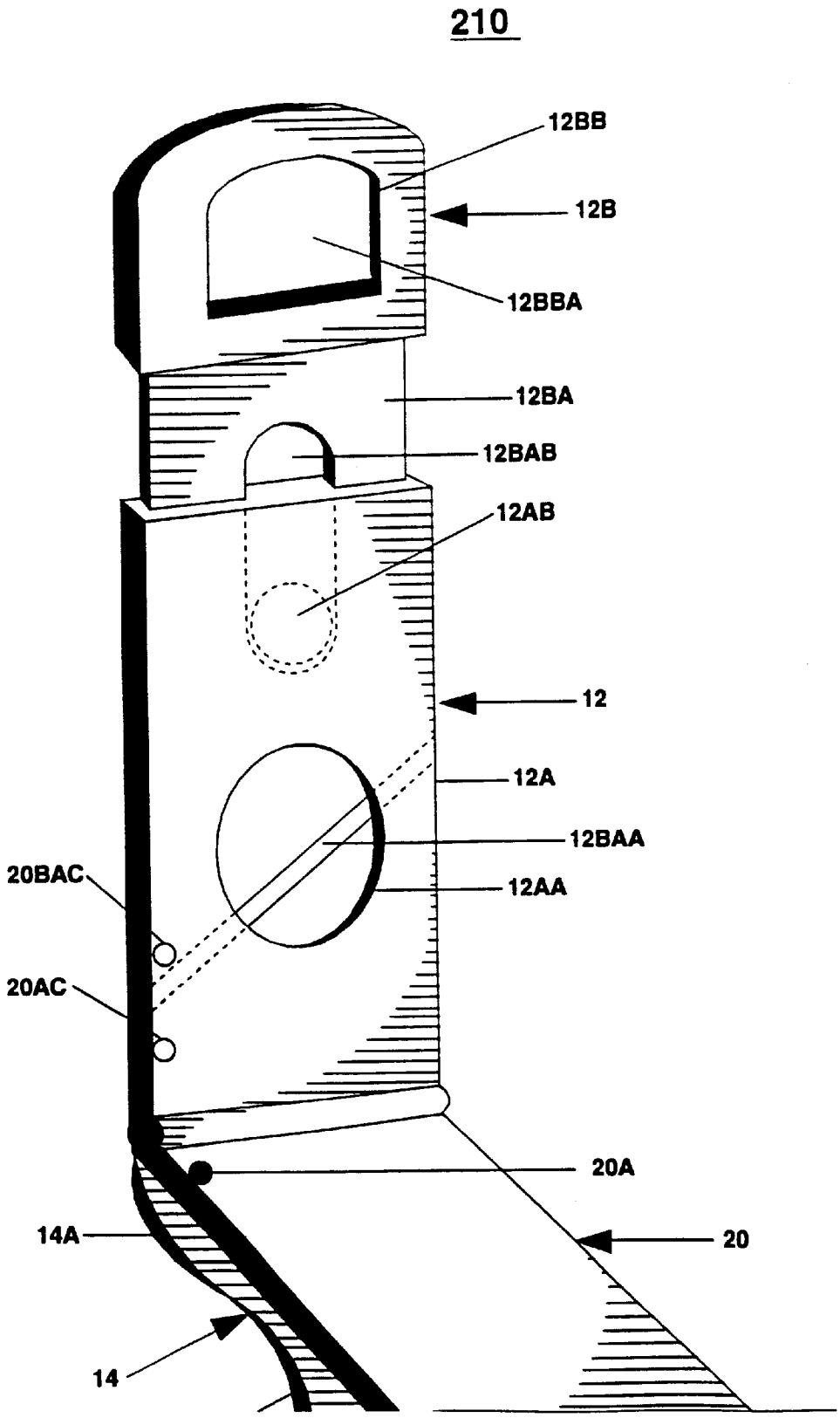
FIG. 6 is a top-left perspective view of a second cigar cutter money clip with a cigar cutter guillotine and a lock plate in a closed position.

Next referring to FIG. 6 which is top-left perspective view of a second cigar cutter money clip (210) with a lock plate (20) in an open position. The second cigar cutter money clip (210) comprises the cigar cutter (12) which comprises the hollow cigar cutter housing (12A) having at least one cigar cutter housing opening (12AA) positioned through the side thereof. The cigar cutter (12) further comprises the cigar cutter guillotine (12B) slidably disposed in the cigar cutter housing (12A). The cigar cutter housing (12A) still further comprises the cigar cutter housing port (12AC) therein The cigar cutter guillotine blade (12BA) further comprises the cigar cutter guillotine blade opening (12BAC) therethrough. The lock plate (20) further comprises the lock plate post (20A) extending upwardly therefrom. When the user positions the lock plate (20) against the cigar cutter housing (12A) side, the lock plate post (20A) is positioned through the cigar cutter housing port (12AC) and the cigar cutter guillotine blade opening (12BAC) preventing removal of cigar cutter guillotine blade (12BA) from the cigar cutter housing (12A).

The cigar cutter guillotine (12B) comprises the cigar cutter guillotine blade (12BA) having the sharp cigar cutter guillotine blade edge (12BAA). The cigar cutter guillotine blade edge (12BAA) is angled. The cigar cutter guillotine (12B) still further comprises the cigar cutter guillotine handle (12BB) which is securely attached along the top distal edge of the cigar cutter guillotine blade (12BA). The cigar cutter guillotine handle (12BB) further comprises the cigar cutter guillotine handle opening (12BBA) therein functioning as the gripping means.

The cigar cutter (12) further comprises the cigar cutter housing stopper (12AB) positioned through the side, the cigar cutter guillotine blade (12BA) further comprises the cigar cutter guillotine blade slot (12BAB) longitudinally disposed therein. The cigar cutter housing stopper (12AB) is positioned within the cigar cutter guillotine blade slot (12BAB) functioning to prevent complete removal of the cigar cutter guillotine (12B) from the cigar cutter housing (12A). The cigar cutter guillotine blade edge (12BAA) is angled.

The second cigar cutter money clip (210) further comprises the lock plate (20) which is movably connected along the bottom edge of the cigar cutter housing (12A) by the hinge (16).

The second cigar cutter money clip (210) still further comprises the money clip (14) securely attached along the bottom edge to the bottom of the lock plate (20). The money clip (14) functions to hold at least one bill (18) against the side of the lock plate (20). The money clip (14) comprises the money clip convex (14A) attached to the money clip front end (14C) by the money clip concave (14B) which functions to increase holding power on the at least one bill (18).

Figure 7:
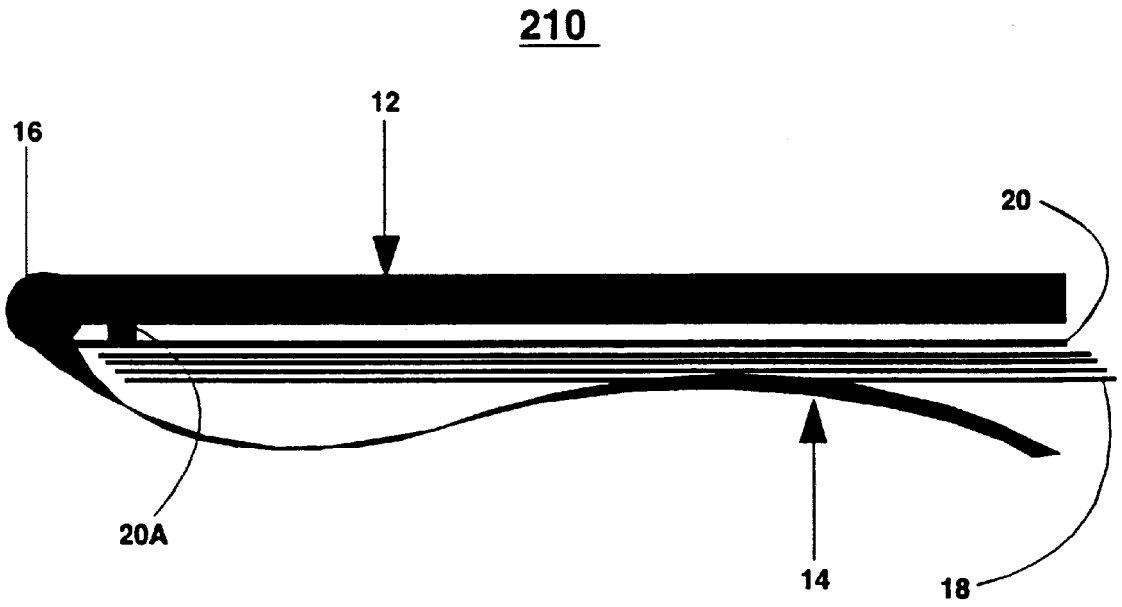
FIG. 7 is a side view of a second cigar cutter money clip with a cigar cutter guillotine and a lock plate in a closed position exhibiting a money clip holding a plurality of bills.

Next referring to FIG. 7 which is a side view of a second cigar cutter money clip (210), with a lock plate (20) in a closed position, exhibiting a money clip (14) holding a plurality of bills (18). The second cigar cutter money clip (210) comprises the cigar cutter (12). The lock plate (20) further comprises the lock plate post (20A) extending upwardly therefrom. When the user positions the lock plate (20) against the cigar cutter (12) side, the lock plate post (20A) is positioned through the cigar cutter housing port (12AC) and the cigar cutter guillotine blade opening (12BAC) preventing removal of cigar cutter guillotine blade (12BA) from the cigar cutter housing (12A).

The second cigar cutter money clip (210) still further comprises the money clip (14) securely attached along the bottom edge to the bottom of the lock plate (20). The money clip (14) functions to hold at least one bill (18) against the side of the lock plate (20).

Figure 8:
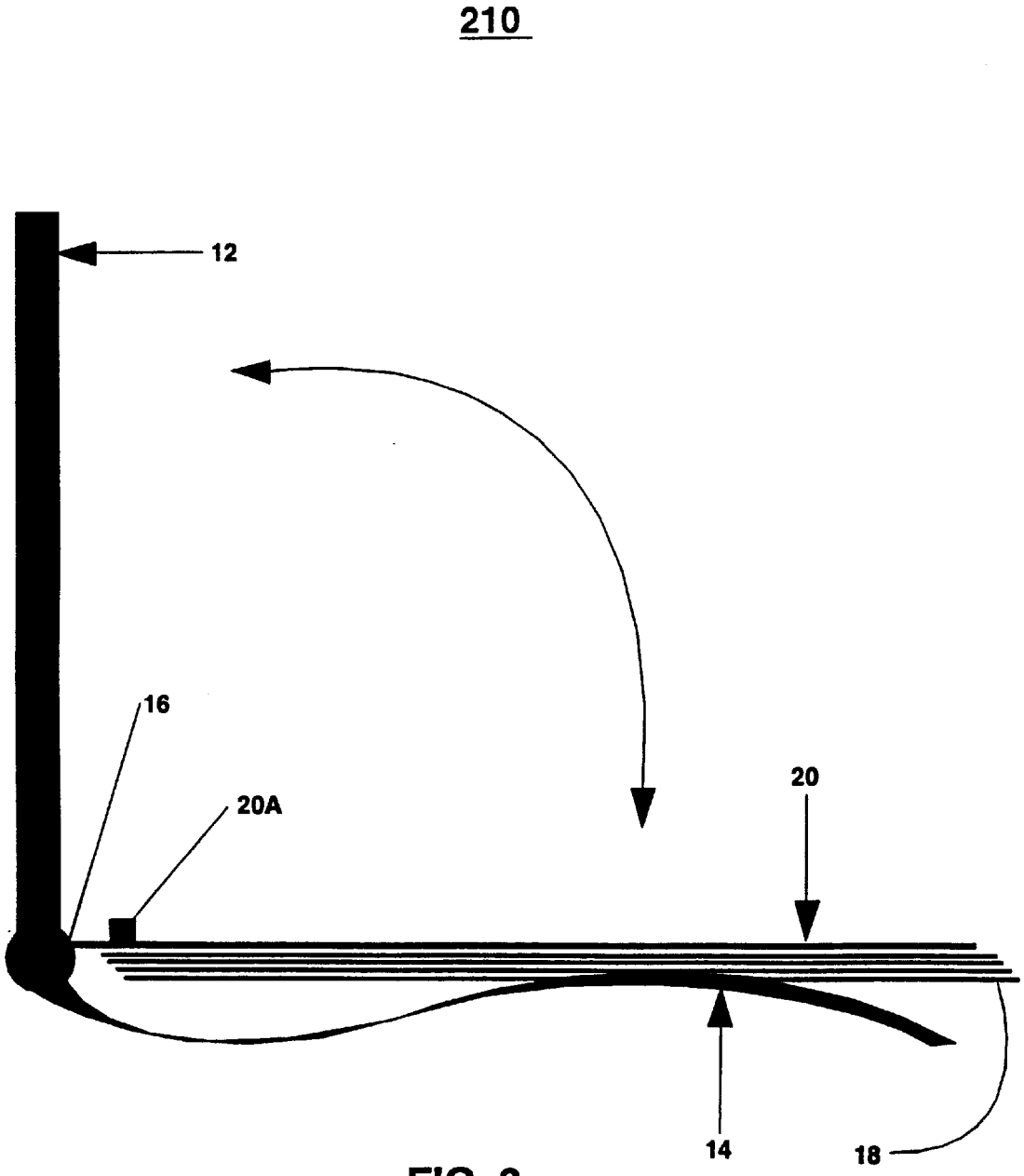
FIG. 8 is a side view of a second cigar cutter money clip with a lock plate in an open position exhibiting a money clip holding a plurality of bills.

Lastly, referring to FIG. 8 which is a side view of a second cigar cutter money clip (210), with a lock plate (20) in an open position, exhibiting a money clip (14) holding a plurality of bills (18). A second cigar cutter money clip (210) comprises the cigar cutter (12). The second cigar cutter money clip (210) comprises lock plate (20). The lock plate (20) comprises the lock plate post (20A) extending upwardly therefrom. When the user positions the lock plate (20) against the cigar cutter housing (12A) side, the lock plate post (20A) is positioned through the cigar cutter housing port (12AC) and the cigar cutter guillotine blade opening (12BAC) preventing removal of the cigar cutter guillotine blade (12BA) from the cigar cutter housing (12A).

The money clip (14) functions to hold at least one bill (18) against the side of the lock plate (20). The money clip (14) comprises the money clip convex (14A) attached to the money clip front end (14C) by the money clip concave (14B) which functions to increase holding power on the at least one bill (18).

It will be understood that each of the elements described above, or two or more together, may also find a usefull application in other types of constructions differing from the type described above.

While the invention has been illustrated and described as embodied in a cigar cutter and money clip, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A cigar cutter money clip (210) comprising:

a cigar cutter (12) which comprises a hollow cigar cutter housing (12A) having at least one cigar cutter housing opening (12AA) positioned through a side of the cigar cutter housing, the cigar cutter (12) further comprises a cigar cutter guillotine (12B) slidably disposed for reciprocation along an axis in the cigar cutter housing (12A), the cigar cutter guillotine (12B) comprises a cigar cutter guillotine blade (12BA) having a sharp cigar cutter guillotine blade edge (12BAA) disposed at a first edge, the sharp cigar cutter guillotine blade edge (12BAA) disposed in an angle respect to the axis of reciprocation, the cigar cutter (12) further comprises a cigar cutter housing stopper (12AB) positioned through the side, the cigar cutter guillotine blade (12BA) further comprises a cigar cutter guillotine blade slot (12BAB) longitudinally disposed therein, the cigar cutter housing stopper (12AB) is positioned within the cigar cutter guillotine blade slot (12BAB), the cigar cutter guillotine further comprises a cigar cutter guillotine handle (12BB) securely attached along at a second edge of the cigar cutter guillotine blade (12BA) opposite to the sharp cigar cutter guillotine blade edge (12BAA), the cigar cutter guillotine handle (12BB) further comprises a cigar cutter guillotine handle opening (12BBA) therein, the cigar cutter housing (12A) further comprises a cigar cutter housing port (12AC) therein, the cigar cutter guillotine blade (12BA) further comprises a cigar cutter guillotine blade opening (12BAC) therethrough, a lock plate (20) comprises a flat member having a first end and a second end, the second end movably connected at a bottom edge of the cigar cutter housing (12A) by a hinge (16), the lock plate (20) further comprises a lock plate post (20A) extending upwardly from the flat member, the lock plate post (20A) is positioned through the cigar cutter housing port (12AC) and the cigar cutter guillotine blade opening (12BAC) when user positions the lock plate (20) against the cigar cutter housing (12A) side such that it prevents removal of the cigar cutter guillotine blade (12BA) from the cigar cutter housing (12A), a money clip (14) comprising a money clip convex (14A) located proximate to the second end of the lock plate (14) at a money clip front end (14C) and a money clip concave (14B) positioned proximate to the first end of the lock plate in a middle of the money clip (14), the money clip (14) securely attached to the second end of the lock plate such that it holds at least one bill (18) against the flat member of the lock plate (20).

* * * * *